United States Patent [19]

Burton

[11] Patent Number: 4,924,504

[45] Date of Patent: May 8, 1990

[54] AUDIO SPEAKER

[75] Inventor: Paul Burton, Alberta, Canada

[73] Assignee: Highwood Audio Inc., Ottawa, Canada

[21] Appl. No.: 123,191

[22] Filed: Nov. 19, 1987

[30] Foreign Application Priority Data

Jun. 18, 1987 [CA] Canada ..... 539976

[51] Int. Cl.[5] ..... H04R 9/00; H04R 7/02; H04R 7/18; H04R 9/04

[52] U.S. Cl. ..... 381/199; 381/193; 381/194; 381/196; 381/202

[58] Field of Search ..... 381/199, 193–196, 381/200, 201–203; 181/173, 174

[56] References Cited

U.S. PATENT DOCUMENTS

| | | | |
|---|---|---|---|
| 1,773,910 | 8/1930 | Lane | 181/173 |
| 1,778,871 | 10/1930 | Smythe | 181/161 |
| 2,047,367 | 7/1936 | Gerdien et al. | 381/193 |
| 2,427,844 | 9/1947 | Eklov | 381/192 |
| 2,923,369 | 2/1960 | Kuhl | 181/173 |
| 2,975,243 | 3/1961 | Katella | 381/191 |
| 3,066,200 | 11/1962 | Pavlak | 381/196 |
| 3,141,071 | 7/1964 | Rich | 381/196 |
| 3,268,672 | 8/1966 | Roesel, Jr. et al. | 381/186 |
| 3,509,290 | 4/1970 | Mochida et al. | 381/195 |
| 3,718,779 | 2/1973 | Schoengold | 381/194 |
| 3,821,492 | 6/1974 | Tamura et al. | 381/191 |
| 3,892,927 | 7/1975 | Lindenberg | 381/191 |
| 3,919,499 | 11/1975 | Winey | 381/196 |
| 4,020,296 | 4/1977 | Dahlquist | 381/196 |
| 4,156,801 | 5/1979 | Whelan | 381/158 |
| 4,228,327 | 10/1980 | Sawafuji | 381/193 |
| 4,395,598 | 7/1983 | Lesage | 381/193 |
| 4,426,556 | 1/1984 | Saiki et al. | 381/195 |
| 4,491,698 | 1/1985 | Larson et al. | 381/196 |
| 4,527,017 | 7/1985 | Kopinga et al. | 381/201 |
| 4,544,806 | 10/1985 | Nieuwendijk | 381/194 |
| 4,584,439 | 4/1986 | Paddock | 381/194 |
| 4,703,510 | 10/1987 | Larson | 381/196 |

FOREIGN PATENT DOCUMENTS

| | | | |
|---|---|---|---|
| 661270 | 4/1963 | Canada . | |
| 866963 | 3/1971 | Canada . | |
| 879324 | 8/1971 | Canada . | |
| 902207 | 6/1972 | Canada . | |
| 1009361 | 4/1977 | Canada . | |
| 535083 | 10/1931 | Fed. Rep. of Germany | 381/194 |
| 58-221599 | 12/1983 | Japan | 381/194 |
| 1003608 | 9/1965 | United Kingdom | 381/203 |

OTHER PUBLICATIONS

"New Developments in Electrostatic Loudspeakers" by P. J. Walker; *Journal of the Audio Engineering Society*, vol. 28, No. 11, pp. 795–799.

Journal of the Audio Engineering Society, vol. 28, No. 11, Nov. 1980, pp. 796–798, Walker, P. J. "New Developments in Electrostatic Loudspeakers".

*Primary Examiner*—Jin F. Ng
*Assistant Examiner*—Danita R. Byrd
*Attorney, Agent, or Firm*—Lyon & Lyon

[57] ABSTRACT

An audio full range speaker which achieves the propogation of a peaked wavefront from the diaphragm instead of generating a substantially planar wavefront as in the case of the common speaker construction utilizing a diaphragm driven as a piston. The speaker has a substantially planar, thin, flexible film forming the diaphragm mounted within a frame. The diaphragm is driven by a driver which imparts motion to the diaphragm at a small source area, the motion being imparted in a direction normal to the plane of the diaphragm so that ripples radiate from the drive area and travel at the same time across the flexible diaphragm, one behind the other, towards the frame. The rest of the diaphragm is driven by the central moving portion, endowing it with a built-in time delay. Because of the time delay involved in spreading the energy across the diaphragm, the wavefront radiated by the speaker ges a head start at the center and lags towards the edges. The result is that of a spreading spherical wave front for a point source and a cylindrical wave front from a line source, and allowing a large diaphragm to behave as a small virtual audio source. The full range transducer requires no crossover, equalization or time delay circuits.

2 Claims, 5 Drawing Sheets

AUDIO SPEAKER

BACKGROUND OF THE INVENTION

1. Field of the Invention

This invention relates to an audio transducer, and more particularly, to a speaker structure capable of operating as a full range unit.

2. Description of the Prior Art

A true full range speaker is one which utilizes a single driver to reproduce the whole audible frequency range, as opposed to an arrangement in which two or more drivers, such as woofers and tweeters together, with the required crossovers, are used to produce such a range. In the past, manufacturers have produced speakers that have been termed full range units, but these units have suffered from various problems, and are usually only wide range, not full range. Usually the known units have poor bass output, or if the unit is large enough to have good bass characteristics, they have problems with high frequencies, either because of the high mass of the large driver, or because the large radiating area results in a narrow treble dispersion.

In most known structures of speakers, the diaphragm is driven as a piston. Such a pistonic radiator will produce a substantially planar wavefront when the wavelength of the frequency being propogated is less than the dimensions of the diaphragm. Although numerous designs, which utilize a thin flexible membrane as the diaphragm, have been developed, they have, in the main, made provision for driving the diaphragm as a piston and have therefore experienced the same type of disadvantages. Examples of such pistonic magnetic type speakers are shown in U.S. Pat. No. 3,919,499, granted Nov. 11, 1975, to Winey and U.S. Pat. No. 4,020,296, granted Apr. 26, 1977, to Dahlquist. In these patents, it can be seen that the conductors are spread over a wide area of the diaphragm which gives the effect of the diaphragm being driven as a piston. Dipole or planar units, i.e., units which have no box or cabinet for bass loading, but consist of a thin diaphragm stretched on a frame, may be open on both sides and therefore radiate equally in both directions. Such a design has many desirable characteristics, and although such a design is not a recent developement, it is slow in its commercial progress because of cost.

As indicated, most known planar designs follow conventional technology and attempt to drive the moving element as a piston. Full-range pistonic units have been designed. The listener must sit directly "on axis" to consistently hear all frequencies from such transducers. If such a full range speaker achieves a linear frequency response, it then tends to have an energy spectrum which is percieved to rise in intensity with frequency. This is because the radiated sound is increasingly concentrated on axis, as treble beaming from the large diaphragm comes into effect. This must then be counteracted by other means, such as a mass induced high frequency roll off. Although this can linearize the frequency response it does not help treble dispersion.

A more common response to these problems is to make use of multiple drivers. Crossovers are then required to separate the appropriate frequency bands and direct them to the different drivers. Each driver has suitable mass and dimensions for reproducing those frequencies without compromising directionality. Even though planar designs can be built with inherently low mass, and consequent predictable out-of-band behavior, the same kinds of crossover filters are still generally employed, introducing phase errors in the reproduced signal. Furthermore, each specialized driver is located at a different point in space. This causes path differences between diaphragm and ear, producing additional phase/frequency anomalies. In some cases, these various factors can to some extent complement each other, but it remains a complex and inexact task to achieve proper sonic integration between the multiple drivers of any two or three way system.

Speakers are being produced which attempt to circumvent these problems by avoiding having the diaphragm act as a piston. In such a speaker, the diaphragm is driven in sections. An appropriate time delay is applied to each section, so as to achieve a peaked wavefront at all frequencies, instead of an increasingly planar wave with rising frequencies. Thus, the speaker acts as a small virtual source. One example uses annular concentric rings to reconstruct a virtual point source while another uses vertical sections to reconstruct a virtual line source, such an arrangement being described in more detail below. In all such cases, the design drives the entire diaphragm area and requires complex delay electronics to achieve the required wave shaping. In many cases the effect is also enhanced by reducing the high frequency content of the signal passed to the outer rings/sections of the driven area, so that the high frequency radiator is actually substantially smaller than the whole diaphragm. Although the performance of these speakers can be impressive, the complexity of the design and the extensive electronics involved makes such structures expensive.

In a development made by Peter J. Walker and incorporated in products sold under the trademark QUAD, an electrostatic transducer has some features which at first appear similar to the present invention. Walker uses electrical segmentation of a single panel to achieve a time delayed wavefront which stimulates a virtual point source located behind the plane of the dipole panel. This is done by dividing the signal bearing stators on either side of the charged diaphragm into annular rings, each ring being fed via a delay line. Only the central section is fed real time signal, the rest being increasing delayed with distance from the center so that the same kind of peaked wavefront as the present point source embodiment is achieved. Although the end result of Walker's development is in some way similar, it is clear that the means by which the effect is achieved is completely different. The entire diaphragm of walker is driven, and the delay is achieved electrically, through a complex series of filters. Not only is a delay applied, but some degree of frequency shading also occurs, that is to say, the outer annular rings are not driven full range, but inevitably feature a high frequency roll off, due to the inductive/capacitive nature of the delay lines. This is actually beneficial in this case because the central area, which is driven full range, is rather larger than his ideal, and tends to beam output in the highest audible octave. Thus, the speaker is neither truly full range, nor without crossover filters. However, it is the only dipole transducer, of which applicant is aware, which really focuses on creating the same type of wavefront profile as the present invention.

SUMMARY OF THE INVENTION

It is an object of the present invention to provide transducers which are economical to produce and yet can operate as full range units without compromising high frequency dispersion characteristics.

According to the present invention, there is provided an audio transducer which includes a frame having a central open area, and a substantially planar, thin, flexible film forming a diaphragm having a portion supported by said frame within the open area of the frame. A means is provided for imparting a motion to a drive area of the diaphragm, the drive area being small relative to the supported portion of the diaphragm so that ripples are created in the diaphragm and radiate away from the drive area in the form of a number of waves travelling at the same time toward the frame.

The drive area may be a centrally disposed point source or a centrally disposed line source.

It can be seen that the present invention is of a simple nature which deliberately avoids making the diaphragm act as a piston. The speaker operates by driving either a central point or line on the diaphragm, the point or line being small relative to the total diaphragm, and the rest of the diaphragm is then driven by the central moving area, endowing it with a built-in time delay, much in the manner ripples spread in a still pond when a pebble, in the case of the point source, or when a slender pole, in the case of a line source, is thrown into the water. Because of the time delay effect as the induced wave travels across the diaphragm, there is a concommitant delay in transmitting the mechanical fore and aft motion of the diaphragm into the air layer immediately adjacent to the plane of the diaphragm. Thus the sound radiated into the surrounding air gets a head start at the central source and lags increasingly with distance across the diaphragm. The result is therefore a peaked wavefront, whose shape is essentially unaffected by frequency. As the distance from the diaphragm increases, and the radiated energy spreads, the sharp peak at the center of the wave becomes modified, and a curved wave results. The effect is therefore a spreading hemispherical wave in the case of the point source, and a spreading cylindrical wave in the case of the line source. Although the diaphragm may be relatively large, say 10"×40", so as to couple well to the volume of air within the room and thereby produce good bass sound, it behaves as if it were a pulsating sphere or cylinder, both of which function as small virtual sound sources, so as to not suffer from treble beaming.

BRIEF DESCRIPTION OF THE DRAWINGS

The accompanying drawings illustrate the principle of the present invention and alternative embodiments, as examples, wherein.

DESCRIPTION OF THE PREFERRED EMBODIMENTS

Figure 1:
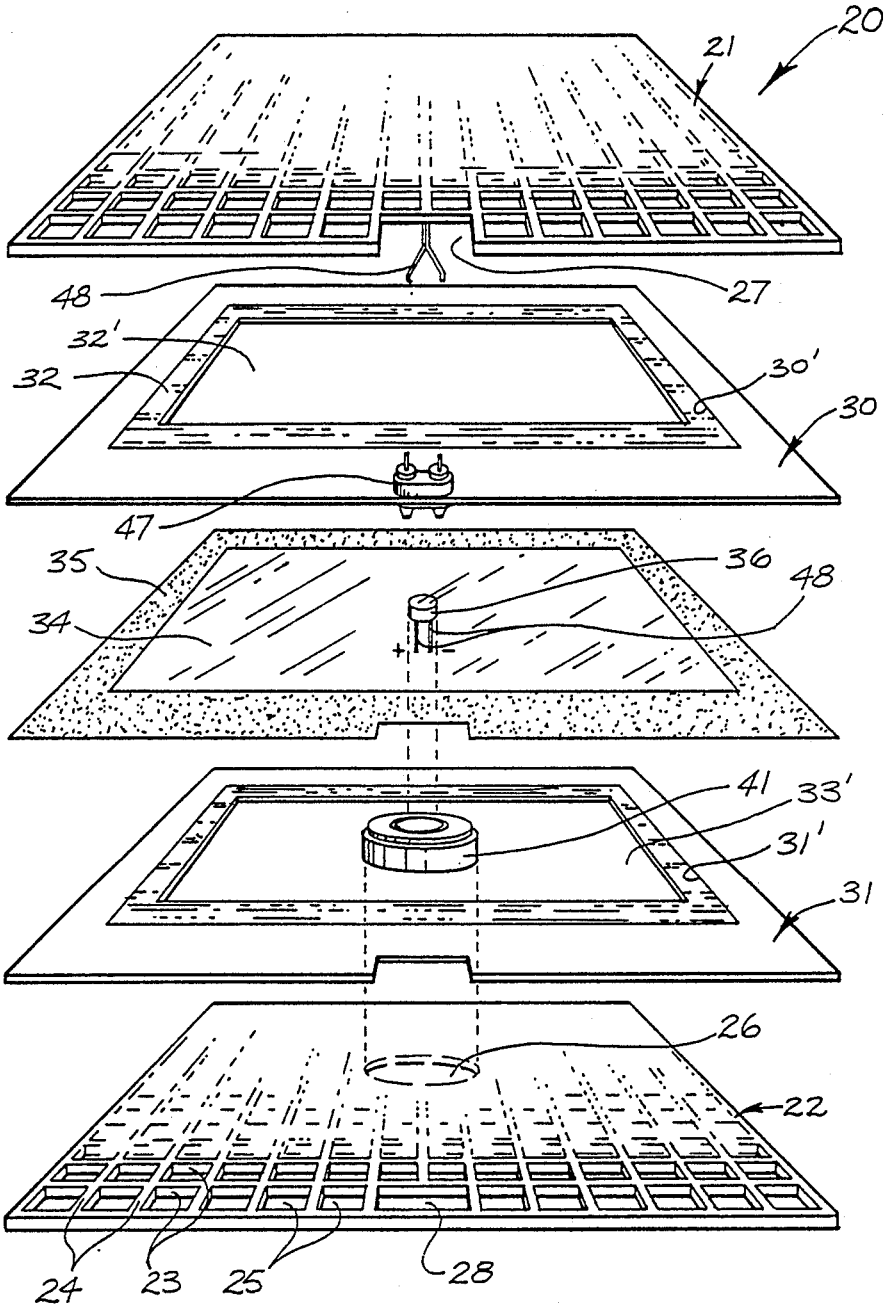
FIG. 1 is an exploded perspective view of a speaker according to one embodiment of the invention having a drive providing a point source.

In the drawings, the reference number 20 generally denotes the overall speaker which, in its assembled form, has very little thickness relative to its height and width. The speaker 20 has front and rear frame members 21 and 22, respectively, which may be of the same outside dimensions and may be in the form of open grill members defined by a plurality of equally spaced, parallel horizontal strips 28 and a plurality of equally spaced, parallel vertical strips 24 thus providing a plurality of rectangular openings 25. The members may be formed of wood or simply moulded as a unit from Styrene or other suitable material.

The rear frame member has a centrally disposed, circular opening 26, and both members 21 and 22 have notched or cut away portions 27 and 28, respectively, near the bottom edge at the centre thereof. A pair of flat, thin, rectangular, front and rear spacers 30 and 31, which may have identical outside width and height dimensions as the frame members 21 and 22, are provided to be clamped in face to face relationship immediately within front and rear frames 21 and 22. The spacers 30 and 31 may also be formed of moulded Styrene or other relatively incompressible material. As is most apparent from FIG. 1, spacers 30 and 31 occupy an area only immediately within the margin of the speaker because they each define a large interior open area 30', 31', respectively, of rectangular shape. Located within the rectangular open areas 30' and 31' of spacers 30 and 31 are damping members 32 and 33 which have outer dimensions to match those of the open areas of the spacers. The members S2 and 33 may be of substantially the same thickness as their respective spacer and be formed of an open cell foam or other similar resilient material which is relatively soft and spongy. The damping members 32 and 33 in turn have large interior open areas 32', 33', respectively.

The speaker 20 has a diaphragm 34 in the form of a thin, flexible film, such as MYLAR or polypropylene. In producing the film for the diaphragm, which may have outer dimensions substantially equal to the outer dimensions of the spacers 30 and 31, there can be provided on opposite front and back surfaces thereof adhesive layers 35 about the margin thereof and in from the edge thereof a distance equal to the marginal width of the spacers 30 and 31. Alternatively, strips of tape having double sided contact cement can be applied about the margin of the diaphragm. Affixed to the diaphragm 34 at a point or drive area of the diaphragm, which may be disposed centrally of the diaphragm, is a coil 36. The coil 36 may be a standard speaker coil, i.e., a cup shaped member 37 having a current carrying conductor 40 wound in one direction therearound (see particularly FIG. 3). In combination with the coil 36, to provide a drive means of the speaker, is a magnet means 41, which may include a conventional speaker ceramic ring magnet slug 46 having a front pole piece 42 and a centre pole piece 43 providing therebetween an annular air gap 44 which receives the cup shaped member 37. The magnet means 41 is fixed within opening 26 of rear frame member 22 and is thus stationary. Varying current flow through the conductor thus imparts motion normal to the plan of the diaphragm, the current being transmitted to the conductor 40 via a pair of lead out wires 48 which extend from the coil 36 to a terminal block 47 located in notched and cut away portions 27 and 28 of the front and rear frame members. The terminal block 47 may have terminals which are accessible from the rear of the speaker when it is assembled.

Figure 2:
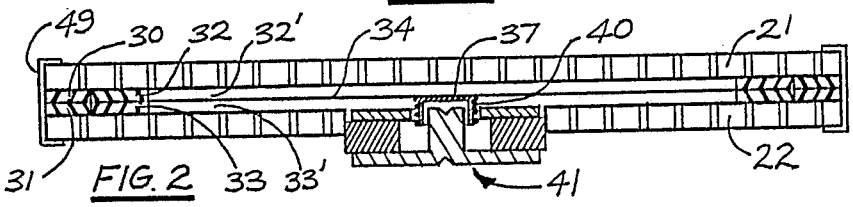
FIG. 2 is a transverse cross-sectional view through through a central area of the speaker of the embodiment of FIG. 1.
Figure 3:
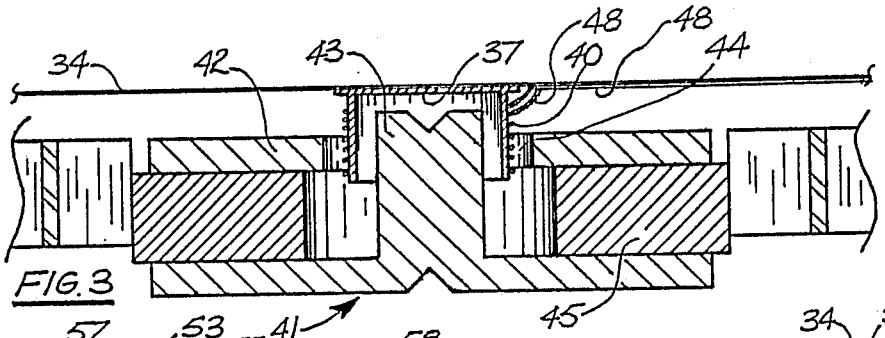
FIG. 3 is an enlarged cross-sectional view of a coil device forming the drive means of the embodiment of FIG. 1.

In assembling the speaker 10, the diaphragm 84 is stretched and located between the facing inner surfaces of spacers 80 and 31 so that as the frame members 21 and 22 are brought into engagement with spacers 30 and 31, respectively, and held in position by edge clamps 19 (FIG. 2), the diaphragm 34, which is affixed to the spacers by the adhesive layers 33, is held in its stretched condition, normally under constant tension throughout the central area within the frame as defined by the rectangular openings 30' and 31' of the spacers. The central portion of each of the frame members 21 and 22, which is the major portion of these members and constitutes all of the area within the marginal portions thereof engaging the spacers 30 and 31, is spaced outwardly a short distance from the opposite planar surfaces of the diaphragm 84. Thus, in the embodiment illustrated, the major portion of the diaphragm, i.e., all of the diaphragm within the central open area of the spacers is entirely unobstructed, with only the marginal area of the diaphragm in effect attached to the frame. The only exception to this unobstructed feature of the diaphragm in the embodiment of FIGS. 1 to 3 is the effect of the damping means provided by the members 32 and 33. The frame members 21 and 22 in the marginally area immediately within the inner edges of the spacers 30 and 31 are in close proximity to the surfaces of the diaphragm and the damping members are thus held lightly against the surfaces. As will be described in more detail below, when the ripples or waves move out from the small drive area of the diaphragm. i.e., the point at which the coil 36 is affixed to the diaphragm, they eventually reach the area immediately inwardly from the portion of the frame formed by the spacers 30 and 31, and here the waves are damped when they engage the damping members on opposite sides of the diaphragm so as not to rebound from the frame.

Figure 4A:
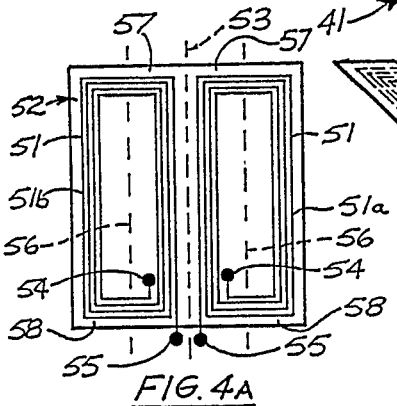
FIG. 4A is a plan view of a member for use in forming an alternative coil structure.
Figure 4B:
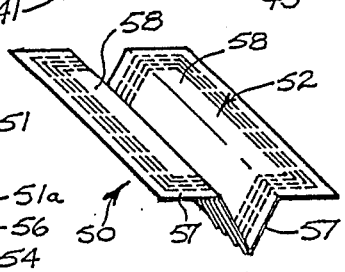
FIG. 4B is a perspective view of the member of FIG. 4B in a partially folded condition.
Figure 5:
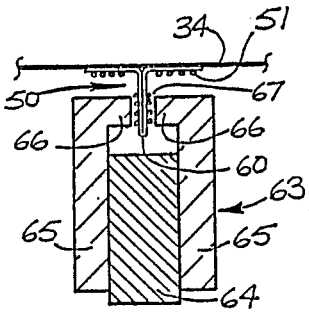
FIG. 5 is a cross-sectional view similar to FIG. 3, but showing a coil device incorporating the member of FIGS. 4A and 4B.

There is shown in FIGS. 4A and 4B and 5 an alternative drive means for use in what may be considered to be dipole point source configuration. The coil 50 is formed by laying out a conductor 51 on a sheet or card 52 of foldable material, the conductor actually having two parts **51*a* and 51*b* laid out in mirror image of each other on opposite sides a central fold line 53 (FIG. 4A). Each part of the coil has a terminal 54 which is juxtaposed the like terminal of the other part of the coil when the card is folded so that both terminals 54 are readily connectable to a common or single leadout wire. Similarly, each part of the coil has a second terminal 55, terminals 55 of the two parts of the coil coming together on folding of the card so as to readily connect to the other of the leadout wires. The card has a pair of additional fold lines 56, 56, which are parallel to and spaced equal distances on opposite sides of central fold line 53. The three fold lines divide the card up into four areas, areas 57, 57 between each of the fold lines 57 and central fold line 53, and areas 58, 58 disposed outwardly of fold lines 56, 56. When the card is folded, as is indicated in FIG. 4B, and then continued to be folded until portions 57, 57 come together and form a flange 60 projecting at right angles from a base or web portion 81 of the coil 50, the base portion 61 being formed by the two portions 58, 58 of the card which are in a common plane as the folding is completed. In the finally folded form, the base portion 61 is bonded to the diaphragm with the flange portion 60 projecting from one side of the diaphragm as shown in FIG. 5**.

When the electrical signals are applied to the coil 50, it can be seen that at any one instant, the current flow in the two adjacent series of conductors in the flange 60 is in one direction, while the flow in the conductors located in the base portion of the coil is in the opposite direction. Magnetic means 63 used in conjunction with the coil 50 includes a magnet 64, or a series of side by side magnets, having at its opposite pole ends, a pair of ferromagnetic pole members 65, 65 which include inward turned end portions 66, 66. The magnet means is fixed to the frame of the speaker in a manner which is not illustrated in FIG. 5. A gap 67 is provided between the end portions 66, 66 and in which is recieved flange 60 of the coil 50 so that the varying current flow in the conductors in the flange 60 provides forces perpendicular to the plane of the diaphragm 34.

As was previously described, the present invention deliberately avoids making the diaphragm act as a piston, but in the embodiments of the invention as described above, the drive is imparted to the diaphragm as a point source. The rest of the diaphragm is then driven by the moving central portion, endowing it with a built-in time delay so that in spreading the energy across the diaphragm, the ripple or wave initiates in the diaphragm at the central drive area and travels to the outer margins of the diaphragm where it is damped before it has an opportunity to rebound from the edge. A wavefront thus travels through the air away from the speaker and in effect gets a head start at the centre of the diaphragm and lags towards the edges so as to result in a spreading spherical wave.

Figure 6A:
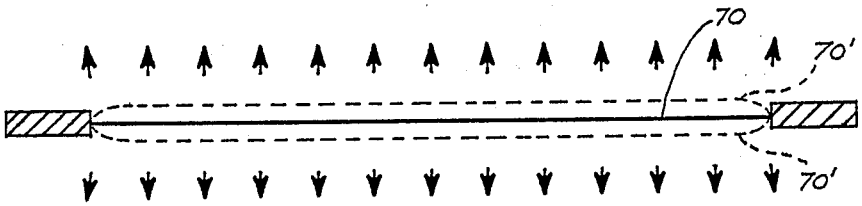
FIGS. 6A, 6B and 6C are cross-sectional views through a diaphragm and depict by way of arrows the manner in which a wavefront departs from a diaphragm which is driven as a piston.
Figure 6B:
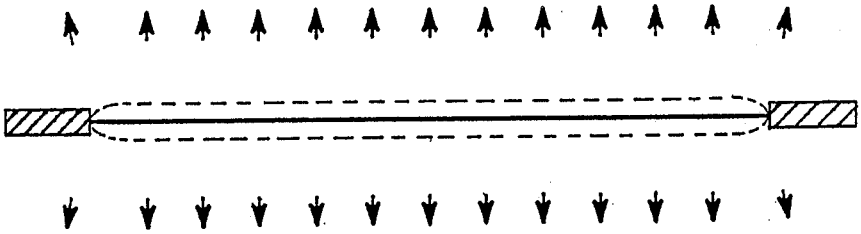
Figure 6C:
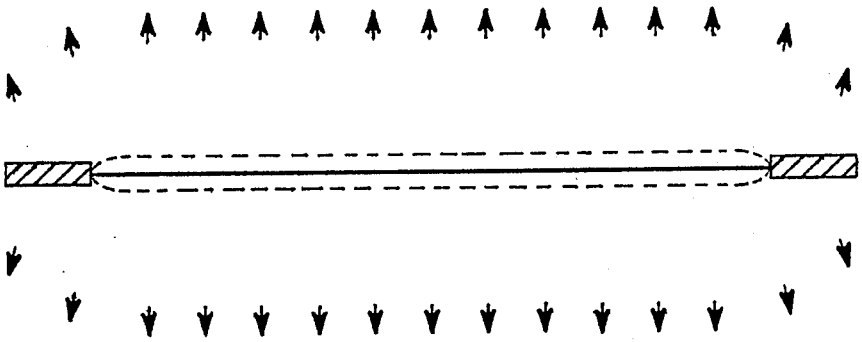

FIGS. 6A–6C and 7A–7D show a comparison between the manner in which the sound waves move away from a diaphragm which is driven as a piston, and alternatively, by a small central driven area, as in the present invention. In FIG. 6A, the arrows depict the wavefront departing from a diaphragm 70 driven in phase over its whole surface i e., a typical planar speaker acting as a piston, the dashed line 70' indicating, in a somewhat exaggerated manner, the diaphragm displacement. A substantial planar wavefront travels away from the diaphragm (FIG. 6B), and although some spreading occurs at the edges of the wavefront, the wavefront remains substantially planar (FIG. 6C), particularly when the wavelength of the frequency being radiated is small in comparison to the size of the diaphragm. The resulting poor dispersion of the radiated energy thus produces treble beaming.

Figure 7A:
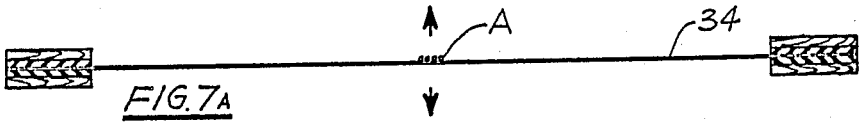
FIGS. 7A, 7B, 7C and 7D are cross-sectional views through a diaphragm and depict by way of arrows the manner in which a wavefront leaves a diaphragm over a period of time in an arrangement where the diaphragm is driven from a central driving coil in accordance with the present invention.
Figure 7B:
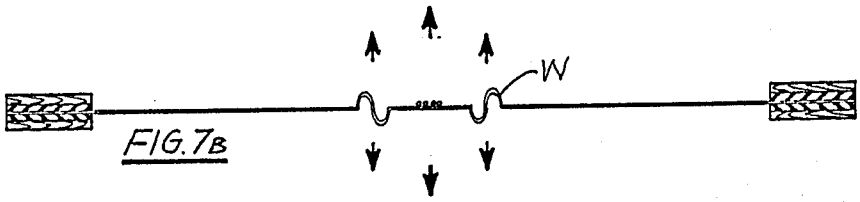
Figure 7C:
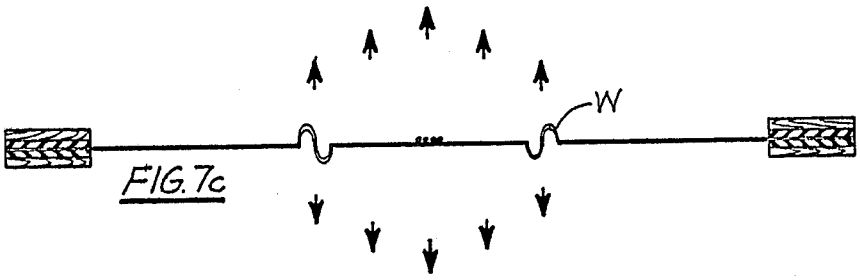
Figure 7D:
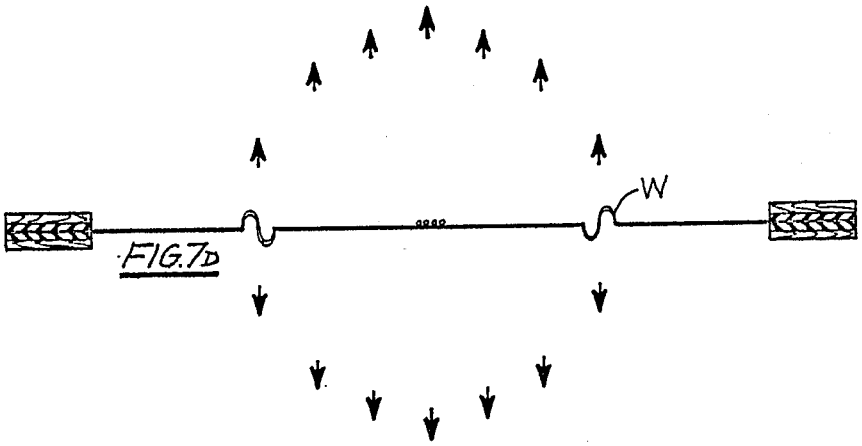

Looking at FIG. 7A, it can be seen that the initial coil vibration, which occurs at a central driving coil A, is perpendicular to the plane of the diaphragm 34. The ripple or wave W caused by the spreading wavefront spreads outwardly from the central area (FIG. 7C), and a time delay occurs as the wave travels across the diaphragm. i.e., the edge of the wave lags the centre in time. Therefore, a spreading "V"-shaped sound wave in the air results and as it spreads into the room, it tends to round off its peak and become substantially circular as viewed in the cross-section of the diaphragm. As the ripple travelling in the diaphragm away from the central drive area eventually meets the marginal area within the frame it engages the damping material where its energy is dissipated.

It can be seen, therefore, that while the wave resulting in the air from the piston-driven diaphragm is planar if the wavelength of the radiated frequency is less than the diaphragm's dimension across the cross-section, in the present invention, planar waves are never produced at any frequency.

Figure 9:
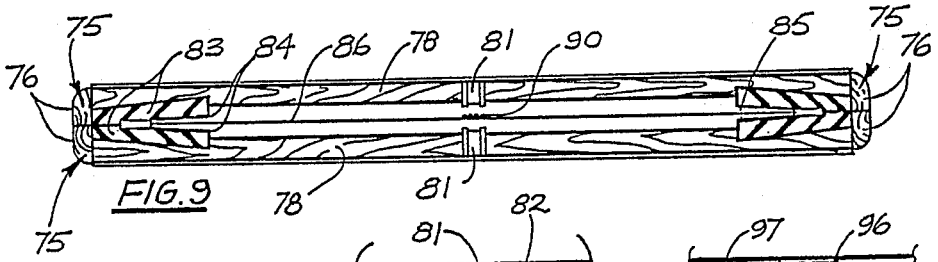
FIG. 9 is a cross-sectional view through a central area of the speaker illustrated in FIG. 8.
Figure 10:
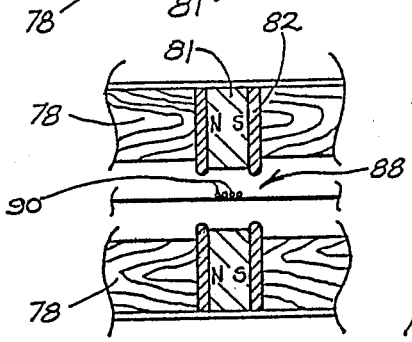
FIG. 10 is an enlarged cross-sectional view of the portion of FIG. 9 including the coil device.
Figure 8:
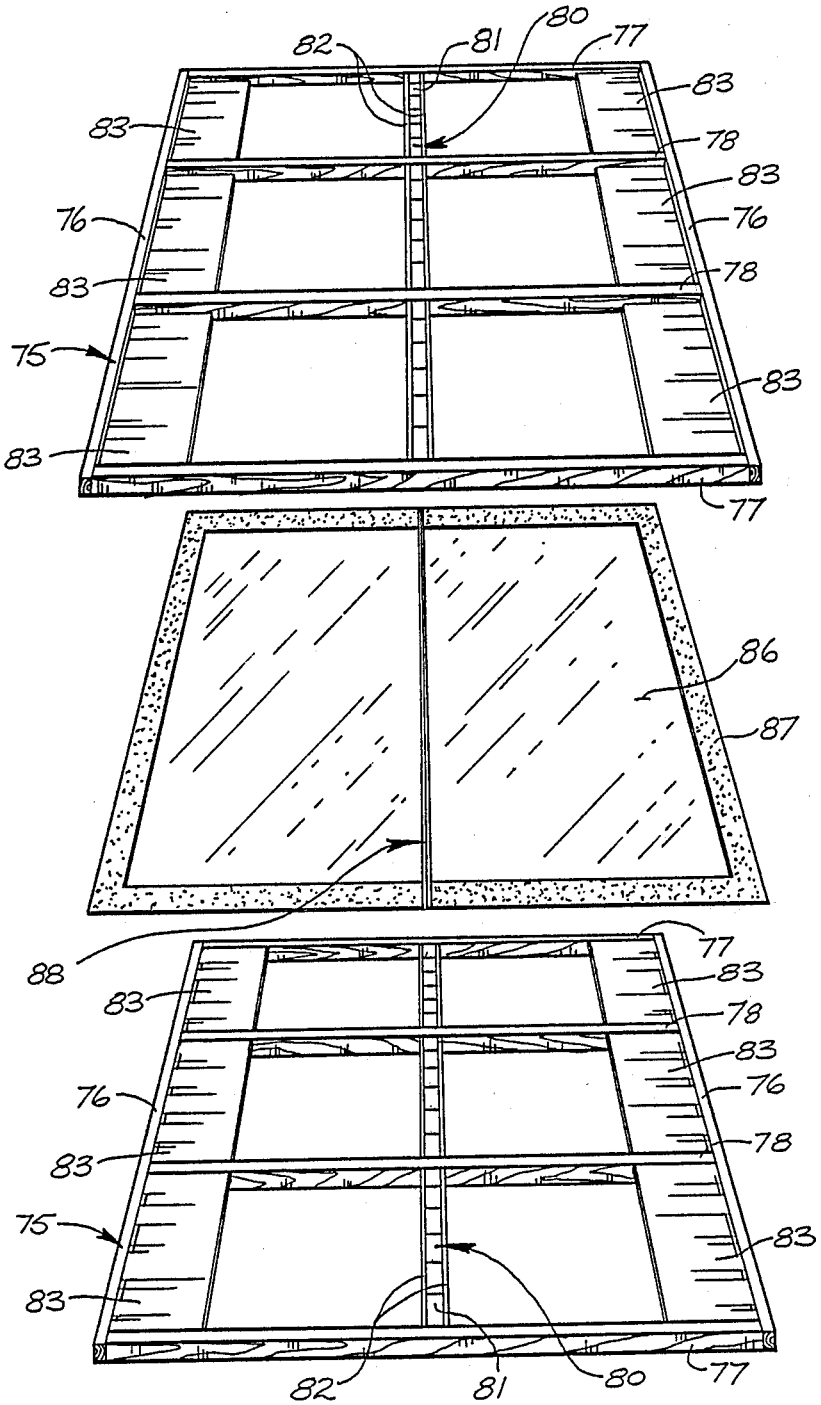
FIG. 8 is an exploded perspective view similar to FIG. but showing an alternative embodiment utilizing a drive means providing a line source.

Turning now to the embodiment shown in FIGS. 8 to 10, there is shown a dipole line source configuration. The front and rear frames 75 may be of identical structure and include side edge pieces 76, end pieces 77 and cross-pieces 78, all of which may formed of wood and bonded together by a well known method. Centrally disposed magnet means 80 extends the full length of both the front and rear frames, the magnet means being supported by the end pieces 77 and cross-pieces 78. As is most apparent from FIG. 10, the magnet means 80 consists of block magnets 81, which may be of the ceramic type, arranged end-to-end and sandwiched between ferrous pole pieces 82. Along opposite sides, immediately inside of the edge pieces 76. 76 of each of the front and rear frames, and between cross-pieces 78 are frame stiffeners 83. As can be seen in FIG. 9, the opposing inside surfaces 84 of the stiffeners 83 in an assembled form, are spaced so as to provide a marginal air space 85 therebetween. The surfaces 84 are tapered or stepped towards the side edge members 76. 76, so that the air space is of decreasing thickness towards the outside of the frame. The speaker has a diaphragm 86 which is clamped in a tensioned condition between the front and rear frames. As in the previously described embodiment, a strip of double sided adhesive tape 87 may provided around the outer periphery of the membrane forming the diaphragm 88, this being the portion of the diaphragm which is clamped between the frames 75, 75 so as to ensure that the diaphragm remains in a constantly tensioned condition when held by the frame.

The entire central area of the diaphragm is unobstructed in the illustrated embodiment and has a central line area 88 of drive extending the length thereof in the form of a plurality of side-by-side disposed conductors 90, (FIGS. 9 and 10), which are bonded to the membrane which forms the diaphragm 86. The conductors 90 provide a linear coil which is located between the two magnet means 80 carried by the front and rear frames. The presence of two magnet lines, one on either side of the diaphragm compresses the field to render it parallel to the diaphragm in the vicinity of the linear coil so that a signal applied to the coil produces motion normal to the plane of the diaphragm 86. The arrangement of the conductors 90 forming the linear coil and their connection to the leadout wires (not shown) are such that the current flows in the same direction in all of the coil's turns in the magnet gap between the pair of magnet means. The return run for the linear coil may be mounted on the frame adjacent the edge. The linear coil my include 4 to 8 turns of wire, it being preferable that the width of the coil as bonded to the diaphragm is less than the wavelength of the highest frequency of sound to be emitted from the speaker.

The diaphragm with a line source, as shown in FIG. 8 has a magnetic field arrangement which provides higher field densities with higher diaphragm excursion from the central resting position. This combats the Mylar diaphragm's dynamic compliance. i.e., the further from rest it is displaced, the harder it is to move. Of even more importance, however, the speaker is a pure resistance, electrically, with substantially no inductance or capacitance so that not only is it a true full range speaker with ideal dispersion characteristics, but it is also the perfect load for an amplifier, with no phase swings or reactance.

Although two alternative structures have been shown for providing either a point source or a line source, it is apparent that means could be utilized to provide a series of closely spaced point or short line sources which are aligned so as to provide much the same effect as one continuous line source.

The manner in which ripples or waves would move in the diaphragm away from the drive area for the point source, as shown in FIG. 7, is the same if viewed in the cross-section for a diaphragm having a line source, as shown in FIGS. 8 to 10, but as previously described, for a line source the wavefront travelling through the air away from the speaker would be cylindrical, rather than spherical as in the point source.

In the embodiment shown in FIGS. 8 to 10, edge damping is achieved by the use of a thin layer of air which is disposed between the marginal portion of the diaphragm 86 and the portion of the frame which projects over opposite surfaces of the diaphragm in close proximity thereto. i.e., the stiffeners 83. As the ripples in the diaphragm enter the small spaces or layers of air confined between the inner surfaces of the rigid stiffeners and the surfaces of the diaphragm, the trapped air resists further travel of the ripples, the energy of which becomes dissipated. This dissipation is more effective if the thickness of the air layers decreases in an outward direction, as achieved by having the inner surfaces of the stiffeners stepped or tapered as shown.

Figure 11:
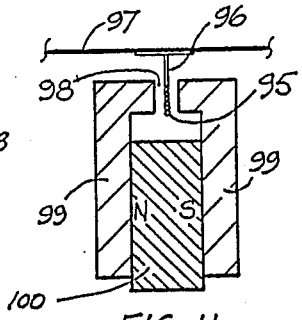
FIG. 11 is a cross-sectional view similar to FIG. 10, but showing an alternative embodiment of the coil device.

An alternative design of the magnetic drive means for the line source arrangement is shown in FIG. 11. The conductors 95 in this embodiment are carried on a flange 96 which extend perpendicularly to the surface of the diaphragm 97, the conductors 95 being disposed in an air gap 98 of pole pieces 99 which sandwich a magnet 100. This embodiment can be an elongated version of that shown in FIGS. 4 and 5, and wherein magnet 100 is, in fact, formed by a plurality of magnet members in an end-to-end fashion.

Because a rectangular diaphragm under constant tension, loaded with a constant mass down its length and driven as a line source may resonate at a single quarter-wave fundamental frequency, and at harmonics of that frequency, in view of the fact all parts of the diaphragm have the same width, tension and mass and therefore all parts of the diaphragm are excited to resonance at the same frequency, it may be desirable to vary some of the parameters of the diaphragm. Instead of having the diaphragm under constant tension as described above, the tension of the diaphragm may be varied down its length. In addition to this feature, or as an alternative, the width of the speaker may be varied, for example, the speaker may be the shape of a truncated isoceles triangle. Another means of combating tympanic resonant modes in the tensioned diaphragm is that of providing a variable mass loading of the diaphragm in the vincinity of the linear coil down the length of the speaker. This means can be in the form of a pair of thin aluminum strips of variable widths affixed to the diaphragm immediately adjacent opposite sides of the linear coil. Another alternative to this means is to use strips of constant mass but vary their distance from the linear coil along its length as is illustrated in FIGS. 12 and 13, which will be described in more detail below.

Figure 13:
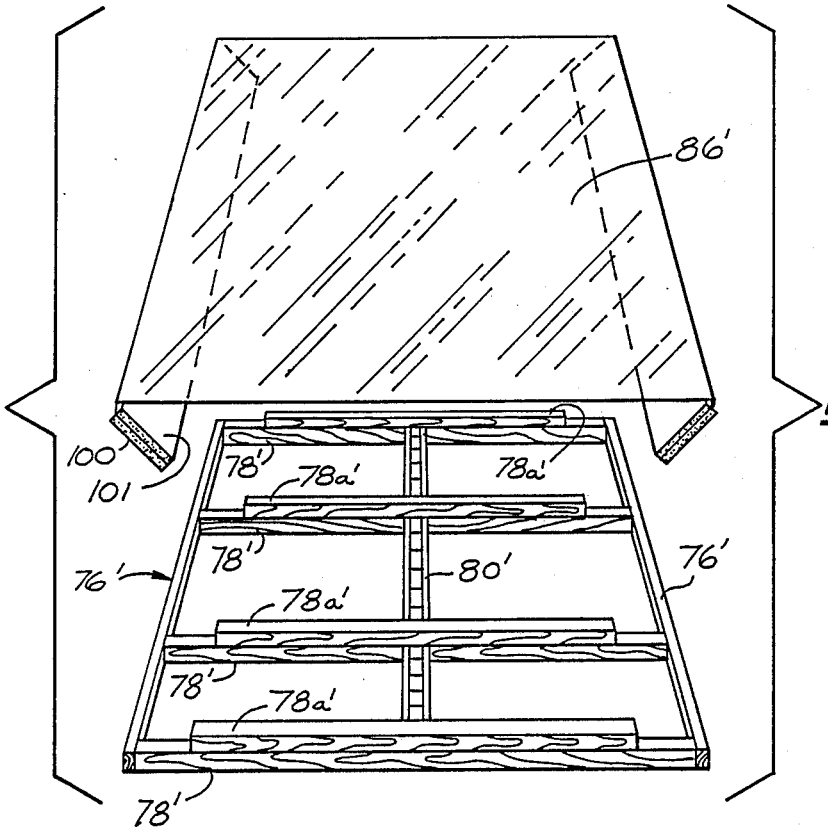
FIG. 13 is perspective view of the speaker shown in FIG. 12 at one stage of assembly.
Figure 12:
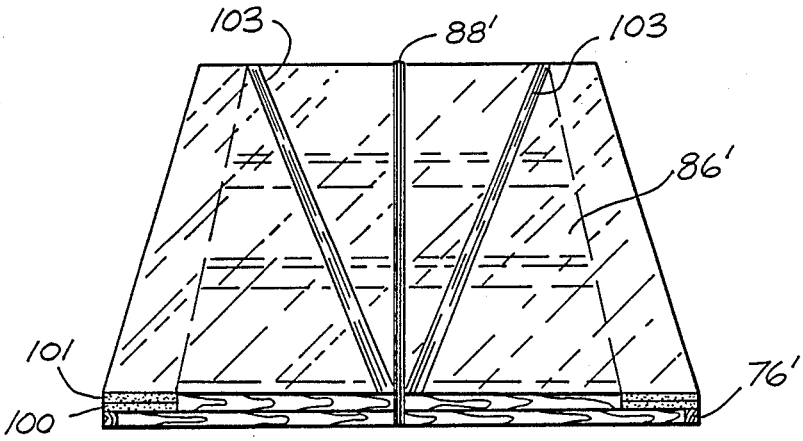
FIG. 12 is a perspective view of yet another embodiment of the present invention.

The embodiment of the invention shown in FIGS. 12 and 13 utilizes an single ended system which is less expensive to manufacture, and although somewhat less efficient as a transucer than the other embodiments, it has the advantage of having no front magnet structure to disrupt the wavefront from the central portion of the diaphragm. The frame 75' is similar to the the rear frame 75 of the embodiment shown in FIG. 8, and includes edge pieces 76' and cross pieces 78'. Mounted in cross pieces 78' and extending the length of the frame is a magnet means 80' which is located only on one side of the diaphragm 86'. The cross pieces 78' include supplementary pieces **78'*a* so that there is in effect provided a notched area at the outer end for receiving slats 100 and 101 between which the outer edges of the diaphragm are clamped, the diaphragm passing over the top of and around the edge of outer slat 100. To fasten the diaphragm 86' to the frame 75', the edges of the diaphragm are clamped between the slats 100 and 101, and the slats are then turned over and forced into the notched areas at the outer edges of the frame 75' so that the diaphragm is stretched evenly across the central portion of the speaker, this operation being depicted in FIG. 13. After the diaphragm is affixed to the frame, conductors 88' are fastened to the outer surface of the diaphragm 86' so as to extend along the outer surface of the diaphragm immediately over the magnet means 80'. A pair of aluminium strips 103 is then affixed to the outer surface of the diaphragm and diverge from the conductors 88'** from one end toward the other of the diaphragm for the purpose of combating resonance as is discussed above.

By using one or more of the above described arrangements to break up the resonant modes, only a small part of the diaphragm will resonate at any frequency, and the small resonant area will tend to be damped by its neighbouring areas, which, as they are not themselves in resonance, will resist motion.

As can be readily observed, the speakers may have the appearance of a very thin panel, which can be mounted, for example, with brackets so as to project at right angles from the side walls of a room, or alternatively, they can be simply leaned against the end wall of a room and readily moved from one location to another for use. The entire speaker of the type shown in FIGS. 1 and 2 can be covered with an attractive fabric, or in the case of the speaker shown in FIGS. 8 and 9 the entire speaker, with the exception of the wood side edge pieces and end pieces, can be covered with a fabric as shown at 102. If the embodiment shown in FIGS. 8 and 9, the fabric can be omitted, and the diaphragm 86 formed of a transparent membrane so that the speaker has the appearance of a window.

Although the speaker is preferably made relatively large, and full range is obtained from a single diaphragm, the same principle, i.e., the use of a flexible diaphragm driven from a narrow line or small point source, can be used for speakers which are not of a full range type. Moreover, a single speaker frame, may carry more than one diaphragm with the two or more diaphragms being in parallel planes driven by single or separate drive means.

Other alternatives may be used in the present invention, such as that of replacement of the magnetic drive systems described with an electrostatic system driving a small portion of the diaphragm area in a similar manner.

Various additional modifications will be obvious to those skilled in the art without departing from the spirit of the invention as defined in the accompanying claims.

What I claim is:

1. An audio transducer comprising:

a frame having a central open area, a substantially planar, thin, flexible film forming a central portion thereof supported by said frame within said open area of said frame, means for imparting a motion to a drive area of said diaphragm in a direction normal to the plane of the diaphragm, said drive area being small relative to the supported portion of the diaphragm whereby waves are created in said diaphragm and radiate away from said drive area in the form of a number of waves travelling at the same time toward said frame, said motion imparting means being a line source drive in the form of a centrally disposed linear coil provided by a plurality of juxtaposed, parallel conductors affixed to and extending for a distance along said diaphragm, a stationary elongated magnetic means supported adjacent said coil and defining a gap receiving said coil, and a pair of members varying a mass along their lengths provided on immediate opposite sides and extending the length of said linear coil.

2. An audio transducer comprising:

a frame having a central open area, a substantially planar, thin, flexible film forming a central portion thereof supported by said frame within said open area of said frame, means for imparting a motion to a drive area of said diaphragm in a direction normal to the plane of the diaphragm, said drive area being small relative to the supported portion of the diaphragm whereby waves are created in said diaphragm and radiate away from said drive area in the form of a number of waves travelling at the same time toward said frame, said motion imparting means being a line source drive in the form of a centrally disposed linear coil provided by a plurality of juxtaposed, parallel conductors affixed to and extending for a distance along said diaphragm, a stationary elongated magnetic means supported adjacent said coil and defining a gap receiving said coil, and a pair of members which vary in distance from said linear coil length along their lengths being provided on opposite sides and extending the length of said linear coil.

* * * * *